United States Patent [19]

Berry

[11] 3,974,015

[45] Aug. 10, 1976

[54] METHOD OF FORMING COMPRESSION MOLDED ARTICLE

[75] Inventor: Foster W. Berry, Muskegon, Mich.

[73] Assignee: Brunswick Corporation, Skokie, Ill.

[22] Filed: Feb. 15, 1974

[21] Appl. No.: 442,796

Related U.S. Application Data

[60] Division of Ser. No. 212,026, Dec. 27, 1971, abandoned, which is a continuation-in-part of Ser. No. 34,924, April 24, 1970, Pat. No. 3,704,016.

[52] U.S. Cl. ..... 156/245; 156/297; 273/82 R

[51] Int. Cl.[2] ..... A63B 71/00; B29C 3/00; B29G 1/00

[58] Field of Search ..... 156/180, 182, 183, 228, 156/242, 245, 279, 292, 297, 298, 299; 273/82 R, 82 A, 82 B

[56] References Cited

UNITED STATES PATENTS

| | | | |
|---|---|---|---|
| 1,170,339 | 2/1916 | Romünder | 273/82 R |
| 1,182,882 | 5/1916 | Whelan | 273/82 R |
| 1,620,310 | 3/1927 | Whelan | 273/82 R |
| 2,654,606 | 10/1953 | Stearns et al. | 273/82 R |
| 3,230,124 | 1/1966 | Akers | 156/228 |

*Primary Examiner*—Caleb Weston
*Attorney, Agent, or Firm*—David S. Guttman; John G. Heimovics; William G. Lawler, Jr.

[57] ABSTRACT

A bowling pin structure and method of forming the same wherein the cheek portions of the pin are molded to define controlled density wood fiber and binder resin materials secured about a core. The assembly is machined to define the desired bowling pin body configuration. The cheek material is compressed to provide a preselected density distribution to provide high durability and controlled scorability while maintaining the overall weight approximately that of conventional wood pin materials.

4 Claims, 12 Drawing Figures

10
11
12
12a
13
14
15
16
17
18
18a
19
20
21
22
11a
11b
11c
11d
11e
11f
11g
113
213
213a
4.
5.

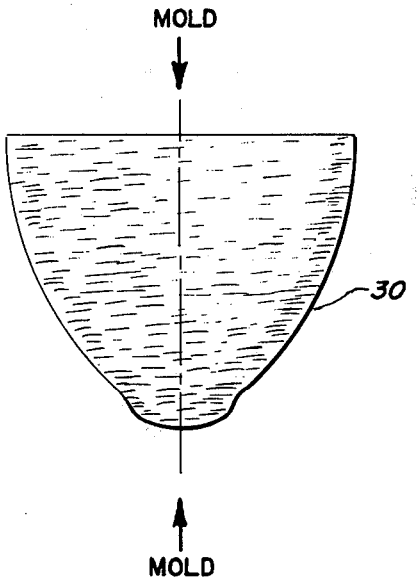
FIG. 9
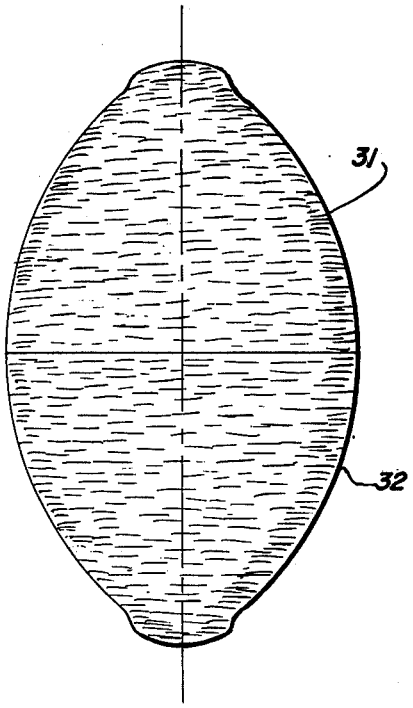
FIG. 10
FIG. 12
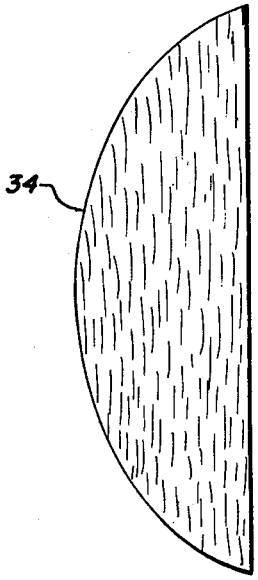
FIG. 11
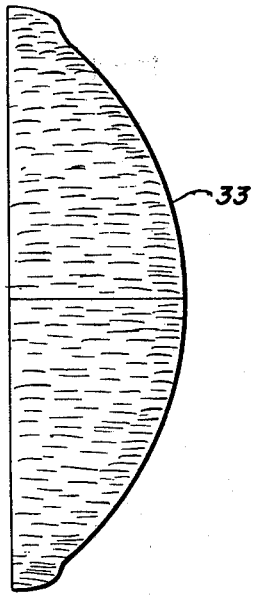

METHOD OF FORMING COMPRESSION MOLDED ARTICLE

This is a division of copending application Ser. No. 212,026, filed Dec. 27, 1971, now abandoned, which in turn, is a continuation-in-part of copending application Ser. No. 34,924, filed Apr. 24, 1970, now issued as U.S. Pat. No. 3,704,016.

BACKGROUND OF THE INVENTION

1. Field of the Invention

The invention related to compression molded articles and in particular to compression molded wooden articles. More specifically, the invention relates to the making of bowling pins utilizing compression molded cheek elements as a portion thereof, and to a method of producing such cheek elements.

2. Description of the Prior Art

The conventional bowling pin is formed by suitable machining of a wood block, such as a maple block. It has been desirable to utilize a particulate wood material in the forming of such bowling pins. However, there has been no fully satisfactory method of utilizing such material because of the difficulty of obtaining the desired durability and scorability while maintaining the desired density of the built-up pin and the overall weight thereof approximately that of a conventional machined wood pin.

One method of forming a conventional solid wood pin is to provide a plurality of cheeks bonded to an axial core member and machine the resultant assembly to the final pin configuration. Such a method of construction minimizes the amount of waste in permitting a general conformity to the pin configuration by the blank defined by the core and assembled cheek elements.

SUMMARY OF THE INVENTION

The present invention comprehends a method of forming a bowling pin wherein cheek elements are formed from particulate wood material within a resin binder. The cheek elements are secured to a core formed of solid wood material by suitable adhesive means and the final bowling pin is obtained by suitable machining of the thusly formed blank.

The invention comprehends an improved method of forming the cheek elements by suitably compressing different portions of a preform proportionally to the thickness. The resultant cheek element may have a preselected density distribution and an overall weight approximately that of conventional solid wood bowling pin material.

The particulate wood material may comprise splinters held by a suitable resin binder preselected to provide desired durability and scorability within the requirements of the bowling industry. The wood particles may be gravity-deposited in a suitable mold cavity to define a preform which is subsequently compression molded with a resin binder to form the controlled density cheek element. The binder may be introduced as by spraying onto the wood particles and tumbling the wood particles with the binder. The binder may be present in a ratio of approximately 8 to 16 percent by weight. The splinters may be elongated having a length of at least approximately 4 times the width thereof to provide an improved cheek construction. The cheek elements may have a resultant density similar to that of the solid wood core and having a distribution whereby the maximum density and durability is provided at the ball line, or belly. The bowling pin further may be arranged to have a preselected center of gravity and moment of inertia conforming to established bowling equipment standards.

By virtue of the ability to control accurately the density of the molded cheek portions, the resultant pins may have a high uniformity in overall weight. Because of inherent variability in the density of normal maple wood, it has been extremely difficult to provide accurately uniform weight in sets of such maple pins. The present invention provides the highly desirable weight uniformity in a simple and economical manner.

BRIEF DESCRIPTION OF THE DRAWINGS

Other features and advantages of the invention will be apparent from the following description taken in connection with the accompanying drawings wherein:

FIG. 9 is a vertical cross section through a compression mold of my invention;

FIG. 10 is a vertical cross section through a body formed by joining two of the molds of FIG. 9;

FIG. 11 is a vertical cross section of one cheek element of the invention wherein the wood chips are oriented in planes generally parallel to the vertical axis of the pin; and FIG. 12 is a cross section of a cheek element of the invention wherein the wood chips are oriented in planes generally perpendicular to the vertical axis of the pin.

DESCRIPTION OF THE PREFERRED EMBODIMENTS

Figures 1, 2, 3, 4, 5, 6, 7, 8:
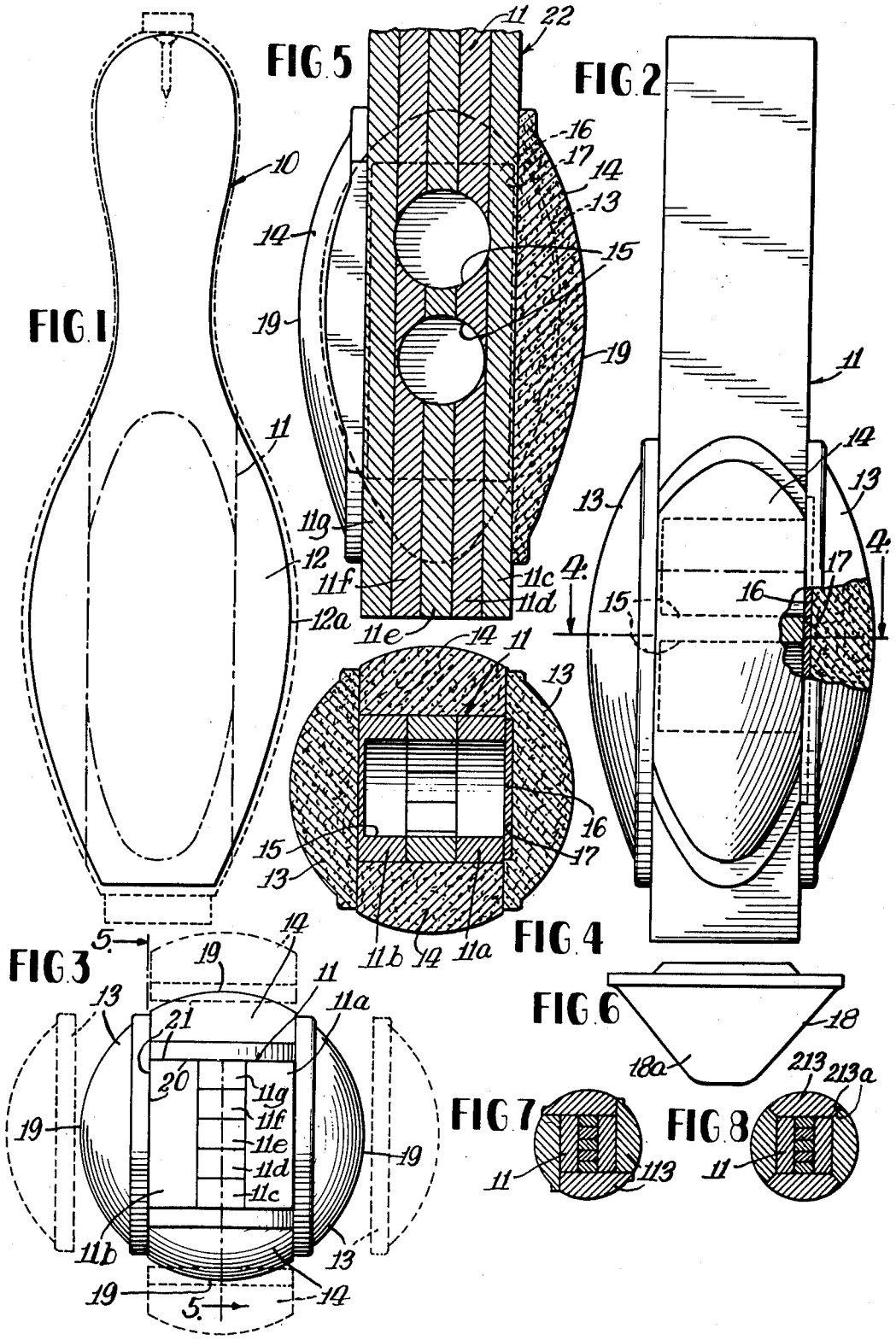
FIG. 1 is an elevation of a bowling pin embodying the invention shown in full lines, with the rough finish configuration thereof illustrated in broken lines.
FIG. 2 is an elevation illustrating an assembled blank construction from which the bowling pin may be machined.
FIG. 3 is a top plan view thereof illustrating the method of assembling the cheek-forming elements in broken lines.
FIG. 4 is a transverse section taken substantially along the line 4—4 of FIG. 2.
FIG. 5 is a fragmentary diametric section taken substantially along the line 5—5 of FIG. 3.
FIG. 6 is a side elevation of a preform for use in forming the cheek-forming elements.
FIG. 7 is a transverse section similar to that of FIG. 4 but showing a modified form of bowling pin embodying the invention.
FIG. 8 is a transverse section similar to that of FIG. 4 but showing a further modified form of bowling pin embodying the invention.

In the exemplary embodiments of the invention as disclosed in the drawings, a bowling pin generally designated 10 is shown to comprise a built-up bowling pin defined by an axial core 11 and a cheek portion generally designated 12 suitably bonded to the core. The present invention comprehends an improved cheek construction providing improved durability and scorability.

Core 11 may comprise a conventional core formed as a laminated center post of a plurality of laminae 11*a*, 11*b*, 11*c*, 11*d*, 11*e*, 11*f* and 11*g*. The illustrated laminated core is exemplary only, it being obvious to those skilled in the art that other arrangements of the laminae of the core may be used as is conventional in the bowling pin forming art. The laminae are suitably joined as by gluing and are preferably formed of conventional bowling pin material, such as maple strips. As illustrated in FIG. 3, the core may be square in cross-section.

It has heretofore been known to form bowling pins by securing portions of wood from discarded bowling pins to such a core permitting machining of this assembly to define a rejuvenated bowling pin construction. The present invention comprehends providing an improved cheek-forming element on such cores to define a new bowling pin construction having substantially improved bowling pin characteristics.

More specifically, cheek forming elements 13 and 14 may be adhesively secured to the core in a quadrangular arrangement as best seen in FIG. 4. One or more holes 15 may be provided in the core overlying the cheek-forming elements to control the weight of the pin. Where such holes are provided, the strips 16 spacing the holes 15 may be provided in suitable recesses 17 in the cheek-forming elements, such as elements 13. Strips 16 may be formed of a suitable material such as maple or other material of like strength preventing extrusion of the cheek material into holes 15 as a result of the forces generated in the use of the pins.

As will be obvious to those skilled in the art, other arrangements of the cheeks about the core may be utilized. Thus, as shown in FIG. 7, a plurality of similar cheek elements 113 generally similar to cheek elements 13, but having one arcuate segment removed to permit overlapping by the next adjacent cheek element, may be utilized. Thus, in this construction, each of the cheek elements is similar. The construction of FIG. 7 provides the further advantage of requiring only a single handling of the core and cheek elements in the gluing operations.

Alternatively, as shown in FIG. 8, a plurality of cheek elements 213 may be provided about the core 11, cheek element 213 having angled edges 213*a* at 45° permitting the cheek elements to be brought together simultaneously for facilitated assembly.

Cheek-forming elements 13 and 14 are preferably formed of wood particles in a suitable binder resin. The cheek-forming elements are formed to have a preselected density simulating that of the bowling pin maple wood and varying from a maximum at the ball line 12*a*, or belly, of the pin. By suitable selection of the materials of which the cheek-forming elements are formed, accurate control of the durability and scorability is readily affected.

The cheek-forming elements may be formed by deposition of resin coated wood particles, such as maple splinters. The wood particles are preferably elongated, having a length of at least approximately 4 times, and up to approximately 8 times the width thereof. The resin binder may be introduced by spraying onto the wood particles and tumbling the sprayed wood particles. As will be obvious to those skilled in the art, other suitable methods of applying the binder may be utilized within the scope of the invention.

The wood particles may alternatively be in the form of flakes, shavings, slivers, shredded wood or chips. In one preferred form, the wood particles comprise coarse splinters which are hammer-milled through a ⅜ inch screen to a screen separator and thence through a No. 10 screen to have approximately 50 percent thereof retained on a No. 18 screen and 50 percent thereof retained on a No. 35 screen. One example of such a wood particle composition is that having the following composition:

| SCREEN | % RETAINED |
|---|---|
| 10 | .1 |
| 12 | 1.5 |
| 14 | 4.4 |
| 16 | 10.7 |
| 18 | 10.0 |
| 20 | 20.0 |
| 25 | 11.7 |
| 30 | 14.0 |
| 35 | 13.7 |
| 40 | 8.3 |
| 45 | 4.1 |
| 60 | 1.3 |
| Pan | .2 |

It has been found that the use of relatively fine material tends to weaken the cheek and, thus, it is preferred that the bulk of the wood particles be larger than those retained on a 35 mesh screen.

The resin binder may comprise a suitable plastic such as urea formaldehyde. Other suitable resin binders include phenol formaldehyde, melamine formaldehyde, etc.

The amount of binder is preferably maintained relatively low such as under approximately 16 percent and over approximately 8 percent. A 12 percent ratio has been found to provide excellent results. The spraying of the resin onto the wood such as while continuously tumbling or moving the wood particles causes an exposure of substantially all surfaces of the particles to the resin to provide an improved bonding with a small amount of resin.

The cheek-forming elements are firstly formed as preforms which may be suitably compressed to have a preselected density. Illustratively, as shown in FIG. 6, a preform 18 such as for use in forming the cheek-forming element 13 is illustrated to comprise a shaped preform which has a thickness preselected so that upon compression thereof to define the cheek element, the density of the cheek element will be greatest at the ball line 12*a* and decrease toward the top and bottom. Illustratively, the density at the top and bottom of the cheeks may be approximately 5 to 10 percent lower than at the ball line. The use of the preform 18 reduces the time of the molding operation desirably.

Illustratively, in forming the preform, a pile of resin coated wood splinters is compressed to about one-third its original loose size. In the molding operation, the preform is compressed to about one-half the preform configuration. Illustratively, starting with a pile of resin coated wood splinters approximately 6 inches high, the preform is reduced to about a 2¼ inch height and the cheek element is compressed to approximately a 1-3/16 inch height at the center.

The forming of preform 18 is effectively a felting operation wherein the wood particles are caused to orient themselves substantially parallel to the flat plane. As is conventional in such felting operations, a vacuum may be utilized to assist the drawing down of the felted mat. The compression of preform 18 is affected in the same direction as the compression of the original pile to form the preform.

The preform is cured in a suitable compression mold (not shown) with suitable application of heat to form the cheek element. Illustratively, where the binder comprises urea formaldehyde, the preform may be cured at 300°F. for approximately 10 minutes. Suitable catalyzing means may be blended with the resin to assure the full curing at this temperature and time.

Another form of the cheek element which has proved to be particularly advantageous is one in which the laminar pattern of the wood chips within the cheek element is parallel with the impact forces from the bowling ball. The chip orientation is accomplished by felting the chips horizontally as illustrated in FIG. 9; and by compressing them vertically into a mold 30 in the shape of the lower (or upper) half of two joined opposing cheek elements. Two such molded elements 31 and 32 are then glued together, as illustrated in FIG. 10, and the resulting shape sawed in half vertically producing two cheek elements such as 33, FIG. 11, having the wood chips oriented horizontally therein. For purposes of comparison, the chip orientation of the earlier cheek elements is illustrated in cheek element 34 of FIG. 12.

One construction of a pin is illustrated in FIG. 3 in which cheek elements 14 are narrower than cheek elements 13 whereby cheek elements 13 overlap the edges of cheek elements 14. The outer surfaces 19 of cheek elements 13 and 14 effectively define in section a circle. The inner surfaces 20 of the cheek elements are flat so as to have facial bonded engagement with the outer flat surface 21 of the core 11. Upon completion of blank 22 shown in FIG. 2 wherein cheek-forming elements 13 and 14 are adhesively secured to the core 11, the blank may be suitably rough machined to the dotted line configuration of FIG. 1 and subsequently finished to the full line configuration of FIG. 1 defining the desired bowling pin. The resultant pin has a preselected density and weight meeting all of the ABC specifications and requirements for bowling pins.

The controlled density of the cheeks made possible by use of the above disclosed method provides an improved cheek construction over conventional solid wood cheeks which may vary substantially in density beyond the controlled range obtainable by the forming method of the present invention. Further, because of the difficulty of controlling grain orientation in solid wood cheeks, improved impact characteristics are obtained with the formed cheeks of the present invention. By controlling the binder and wood particle characteristics and orientation as discussed above, improved durability is obtained. This increased durability is obtained without increasing the overall weight of the pin material as heretofore has been required. Illustratively, the average density may be obtained at approximately 46 to 50 pounds per cubic foot corresponding to the usual density of the hard maple commonly used in such bowling pins.

While the invention has been disclosed primarily in connection with the forming of bowling pins, as will be obvious to those skilled in the art, other wood-like objects may be formed by the novel method of preforming a pile of resin coated wood particles to define a preform having a preselected thickness permitting subsequent compression molding of the preform to result in a molded object having a preselected controlled density distribution notwithstanding a wide variation in the thickness of different portions thereof. This method is particularly advantageous in the forming of bowling pin cheeks as discussed above.

The foregoing disclosure of specific embodiments is illustrative of the broad incentive concepts comprehended by the invention.

I claim:

1. The method of forming a bowling pin body comprising the steps of:

a. molding uniformly dense material of wood fibers and binder resin to define a plurality of cheek-forming elements, the molding comprising the steps of:
   1. forming a cheek preform having a variable thickness; and
   2. compressing different portions of the preform a preselected amount to provide elements having a preselected density distribution, the density being gratest at the pin's ball line;

b. providing a bowling pin core;

c. securing said elements in a series about the bowling pin core to define a blank; and d. finishing said blank to a bowling pin body configuration.

2. The method of claim 1 wherein the cheek-forming elements material is compressed to a maximum density of approximately 46 to 50 pounds per cubic foot.

3. The method of claim 1 wherein the wood fibers are firstly gravity-laid in a preform configuration and subsequently compressed to form said cheek-forming elements.

4. The method of claim 1 wherein said core is provided with an outwardly opening cavity underlying at least one of said cheek-forming elements and a substantially nondeformable plate is disposed between said cavity and the overlying cheek-forming element to preclude deformation of the cheek-forming material into said cavity during use of the bowling pin.

* * * * *